US012350538B2

(12) United States Patent
Tzavaras

(10) Patent No.: US 12,350,538 B2
(45) Date of Patent: Jul. 8, 2025

(54) DUAL UPPER BODY EXERCISER

(71) Applicant: Kosta Tzavaras, Thousand Oaks, CA (US)

(72) Inventor: Kosta Tzavaras, Thousand Oaks, CA (US)

( * ) Notice: Subject to any disclaimer, the term of this patent is extended or adjusted under 35 U.S.C. 154(b) by 189 days.

(21) Appl. No.: 18/354,477

(22) Filed: Jul. 18, 2023

(65) Prior Publication Data

US 2025/0025733 A1 Jan. 23, 2025

Related U.S. Application Data

(60) Provisional application No. 63/367,870, filed on Jul. 7, 2022.

(51) Int. Cl.
*A63B 21/00* (2006.01)

(52) U.S. Cl.
CPC .. *A63B 21/00192* (2013.01); *A63B 21/00069* (2013.01); *A63B 21/4035* (2015.10)

(58) Field of Classification Search
CPC ..... A63B 21/00069; A63B 21/00192; A63B 21/005; A63B 21/0051; A63B 21/0052; A63B 21/0056; A63B 21/0057; A63B 21/22; A63B 21/4035; A63B 21/4049; A63B 23/03516; A63B 23/03525; A63B 23/12; A63B 23/1209; A63B 24/0062; A63B 24/0087
See application file for complete search history.

(56) References Cited

U.S. PATENT DOCUMENTS 3,079,914 A * 3/1963 Bush ..... A61H 1/02 482/903
4,611,807 A * 9/1986 Castillo ..... A63B 22/0005 482/119
4,720,099 A * 1/1988 Carlson ..... A63B 21/0052 482/901
4,730,829 A * 3/1988 Carlson ..... A63B 21/4001 482/901
4,765,315 A * 8/1988 Krukowski ..... F16D 37/02 482/901
4,872,669 A * 10/1989 Henry ..... A63B 21/4047 482/137
5,145,472 A * 9/1992 Johnson, III ..... A63B 21/4049 482/37
5,679,104 A * 10/1997 Driscoll ..... A63B 21/002 482/1

(Continued)

FOREIGN PATENT DOCUMENTS

ES 2628034 A1 * 8/2017
JP 2002282388 A * 10/2002

(Continued)

*Primary Examiner* — Gary D Urbiel Goldner

(57) ABSTRACT

A magnetic resistance exercise pod having first and second machine bodies connected along a mounting body. The mounting body allows for the exercise pod to be mounted onto an exercise frame. Each of the first and second machine bodies has a plurality of magnets within that are controlled by a resistance knob positioned on the mounting body. The first and second machine bodies are connected by way of an exercise bar that allows a user to rotate the exercise pod when in use. The exercise bar is attached to the first and second machine bodies by way of a fastening element.

8 Claims, 9 Drawing Sheets

(56) References Cited

U.S. PATENT DOCUMENTS

| | | | | |
|---|---|---|---|---|
| 6,117,093 | A * | 9/2000 | Carlson | A63B 21/0056 482/44 |
| 10,004,933 | B2 * | 6/2018 | Lennox | A63B 69/0048 |
| 2004/0033868 | A1 * | 2/2004 | Van Straaten | B62M 3/02 482/110 |
| 2008/0312052 | A1 * | 12/2008 | Krietzman | A63B 22/0694 482/92 |
| 2018/0036573 | A1 * | 2/2018 | Lennox | A63B 21/012 |
| 2023/0381568 | A1 * | 11/2023 | Tzavaras | A63B 21/16 |
| 2024/0024727 | A1 * | 1/2024 | Tzavaras | A63B 21/4049 |

FOREIGN PATENT DOCUMENTS

| | | | |
|---|---|---|---|
| KR | 101792216 | B1 * | 11/2017 |
| KR | 200492117 | Y1 * | 8/2020 |

* cited by examiner

DUAL UPPER BODY EXERCISER

FIELD OF THE INVENTION

The present invention relates generally to an exercise machine. More specifically, the present invention is a magnetic resistance exercise machine that provides various handles and mountable features.

BACKGROUND OF THE INVENTION

The dual magnetic-resistance hand-spinning machine is configured for upper-body workouts using magnetic resistance technology, by rotating a handle bar or handles. The magnetic resistance technology allows adjusting the level of intensity of the exercise. The magnetic-resistance hand-spinning machine is designed to provide targeted workouts to critical areas of the body to enhance muscle toning, lose weight around the back and chest areas, and restore lost function for rehabilitation purposes.

An objective of the present invention is to provide the magnetic-resistance hand-spinning machine that can be mounted on a surface using a metal plate base. The machine is surface-mounted in a fixed position using the metal back plate, or adjustable sliding position on a manually-cranked or motorized wall-mounted adapter. The machine provides a single bar configuration or a dual handle configuration. Relative to the machine's position, the machine produces circular arm motion perpendicular to the user's body.

DETAIL DESCRIPTIONS OF THE INVENTION

All illustrations of the drawings are for the purpose of describing selected versions of the present invention and are not intended to limit the scope of the present invention.

Figure 1:
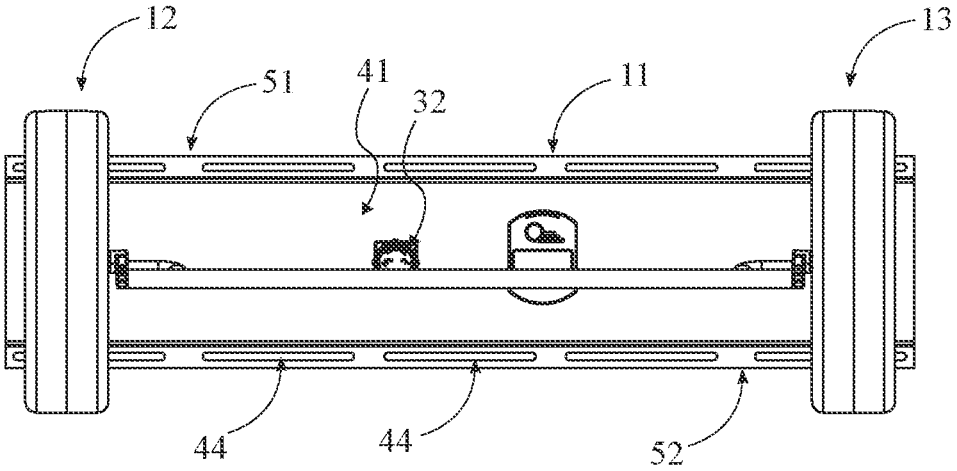
FIG. 1 is a front perspective view of the present invention in accordance with a bar embodiment.
Figure 2:
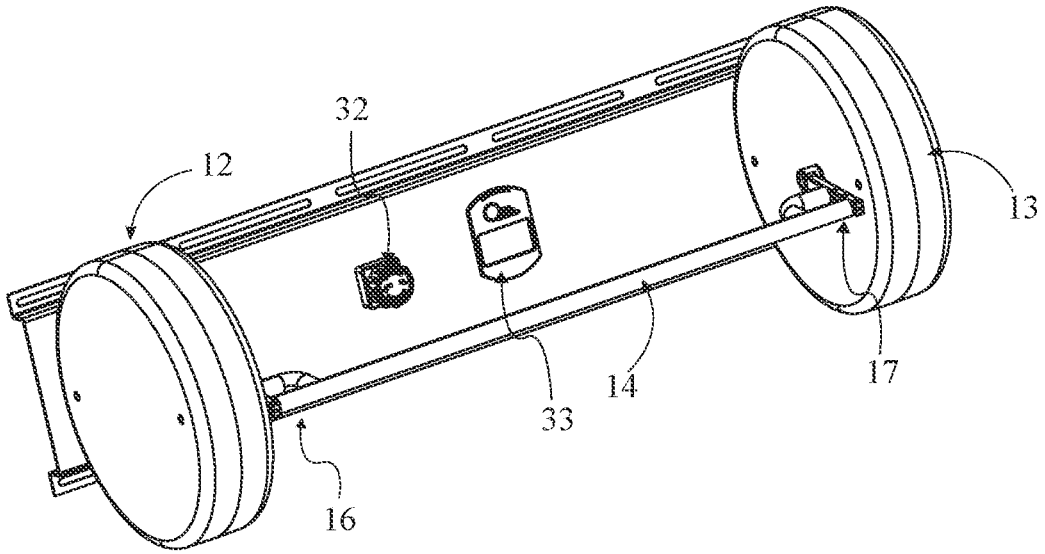
FIG. 2 is a left side perspective view of the present invention in accordance with the bar embodiment.
Figure 3:
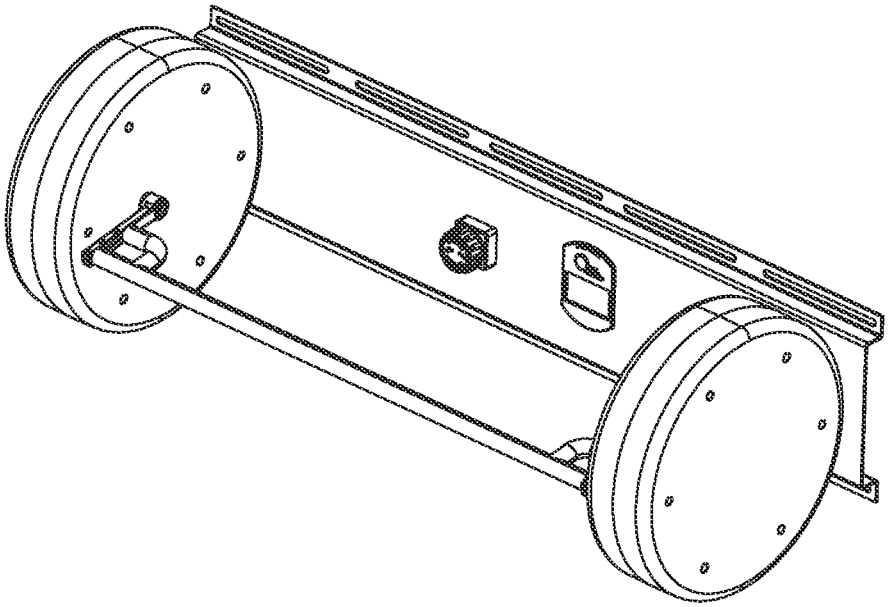
FIG. 3 is a right side perspective view of the present invention in accordance with the bar embodiment.
Figure 4:
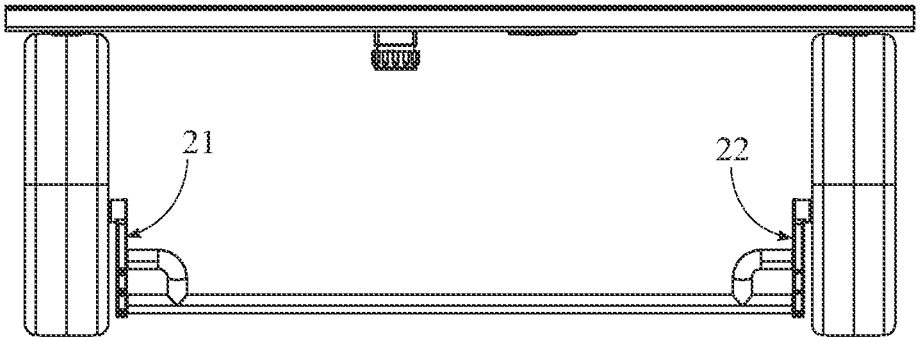
FIG. 4 is a top perspective view of the present invention in accordance with a handle embodiment.
Figure 5:
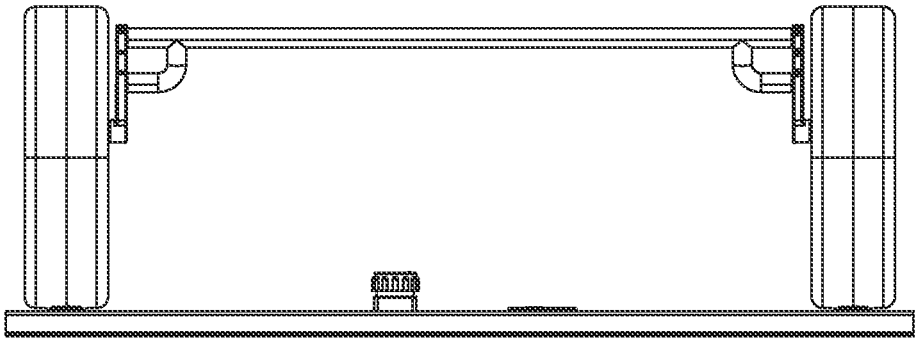
FIG. 5 is a top perspective view of the present invention in accordance with a handle embodiment.
Figure 6:
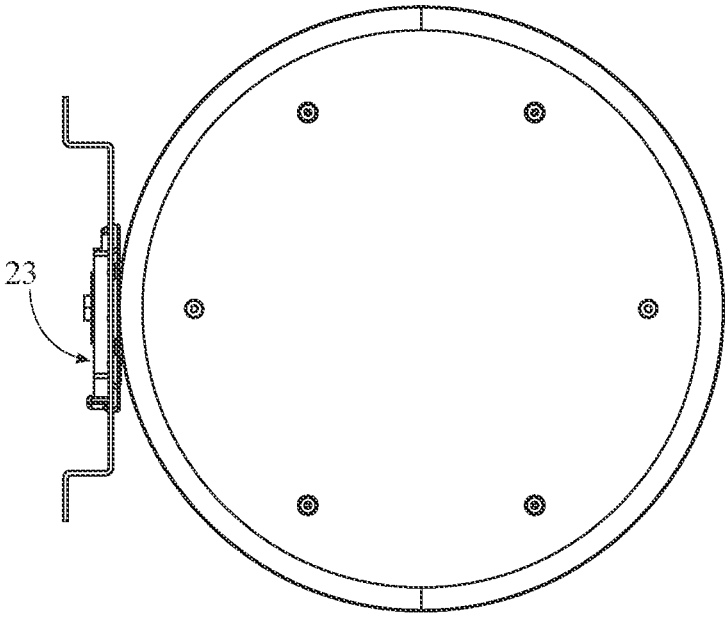
FIG. 6 is a side perspective view of the present invention in accordance with a handle embodiment.
Figure 7:
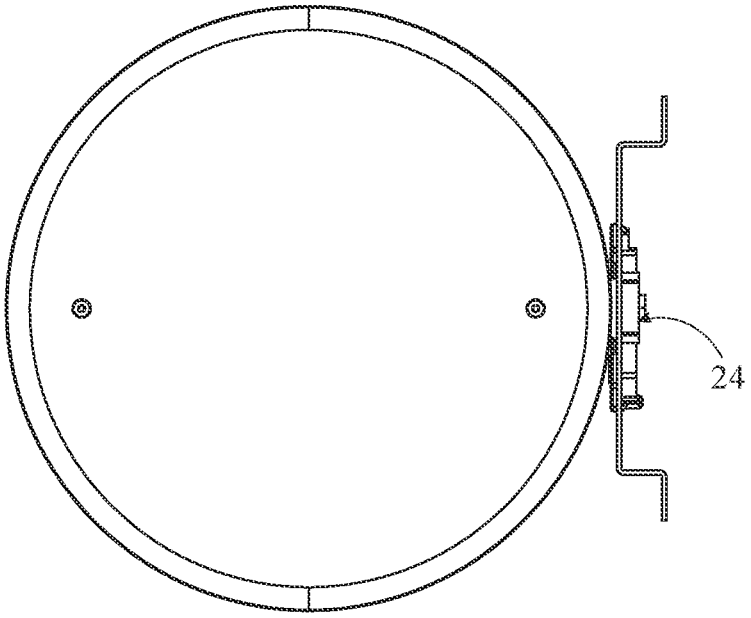
FIG. 7 is a side perspective view of the present invention in accordance with a handle embodiment.
Figure 8:
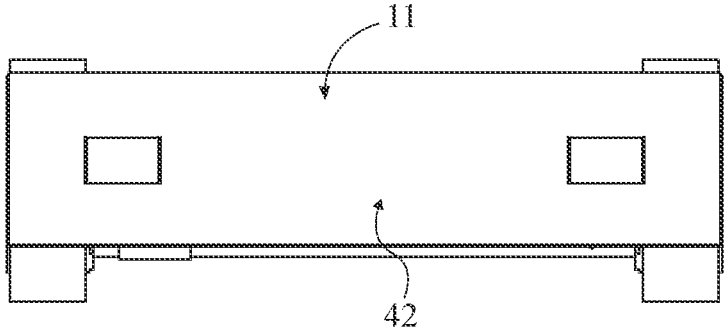
FIG. 8 is a back side perspective view of the present invention in accordance with a handle embodiment.
Figure 9:
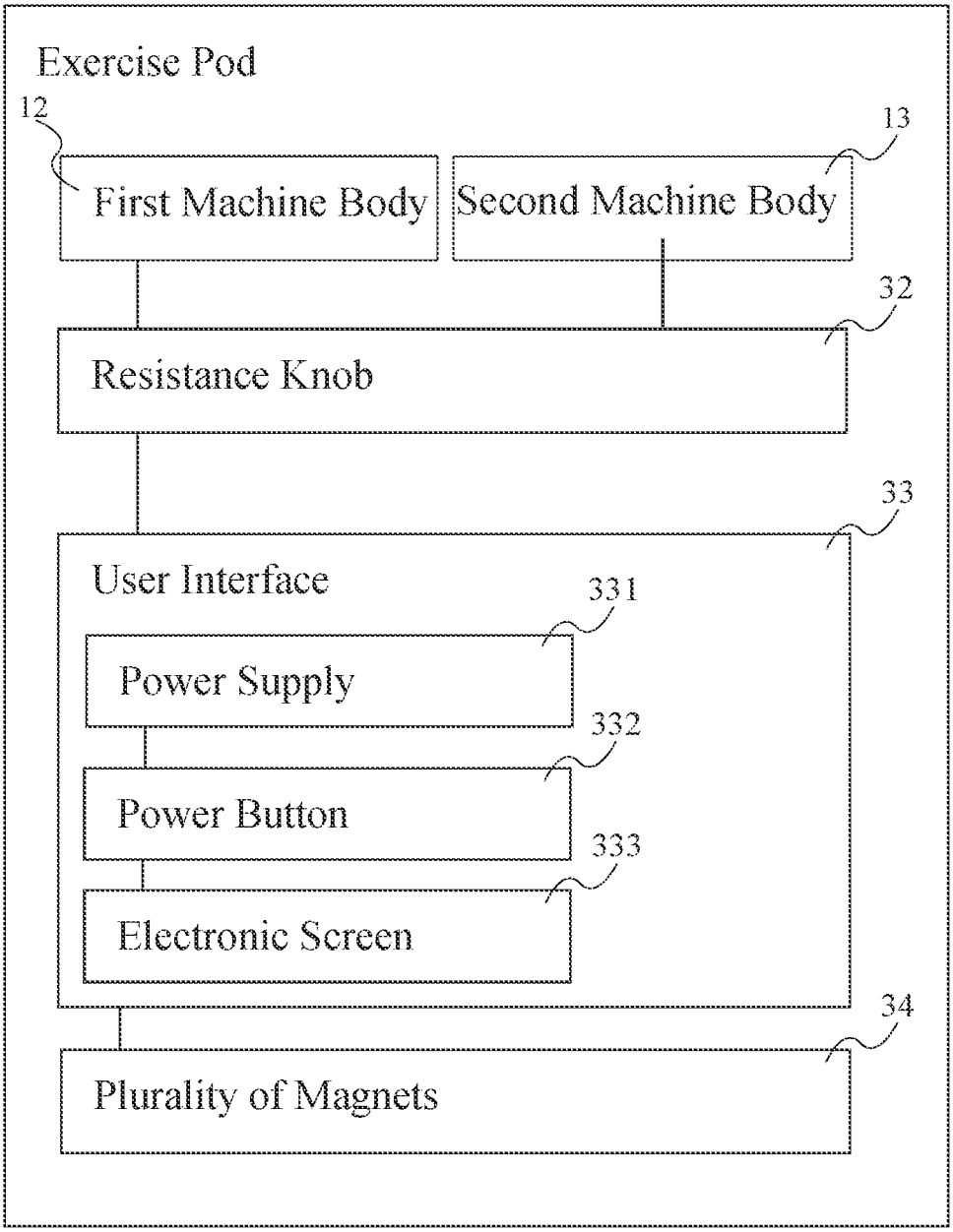
FIG. 9 is a circuit diagram used in the present invention.

In reference to FIGS. 1-9, the present invention is a magnetic-resistance hand-spinning machine 1 that is configured for upper-body workouts using magnetic resistance technology. Similar to bicycle pedals, a user can rotate a singular bar, or dual handles in circular motions using hands to enhance muscle toning, lose weight around the back and chest areas, and restore lost function for rehabilitation purposes. The magnetic resistance technology allows adjusting the level of intensity of the exercise. The present invention can be surface-mounted in a fixed position or adjustable sliding position on a manually-cranked or motorized wall-mounted adapter. In a preferred embodiment, the present invention, also referred to as "The Barrel Roll", comprises a pair of machine bodies, a mounting body 11, an exercise bar 14, a first fastening element 21 and a second fastening element 22, a first base connector 23 and a second base connector 24, a user interface device 33, a resistance knob 32, a power supply 331, and a processing unit. In the preferred embodiment, the pair of machine bodies takes the form of the magnetic resistance machine. In the preferred embodiment, the mounting body 11 serves as the main chassis in mounting the pair of machine bodies. The pair of machine bodies comprises a first machine body 12 and a second machine body 13. The first machine body 12 and second machine body 13 each comprising a plurality of magnets 34. The first machine body 12 and second machine body 13 are connected terminally opposite to each other along the mounting body 11 through the first base connector 23 and second base connector 24. The mounting body 11 is a flat panel in which the first machine body 12 and second machine body 13 are connected. The first machine body 12 is attached to the front side 41 of the mounting body 11 by way of a first base connector 23. The second machine body 13 is attached to the front side 41 of the mounting body 11 by way of a second base connector 24. The first base connector 23 and second base connector 24 allow the first machine body 12 and second machine body 13 to be connected to the mounting body 11 while still allowing the first machine body 12 and second machine body 13 to rotate for when the device is in use.

The exercise bar 14 is torsionally engaged between the first machine body 12 and the second machine body 13 through a first fastening element 21 and second fastening element 22. The exercise bar 14 is a long oblong bar that has a first end and a second end. The exercise bar 14 having a first end 16 and a second end 17. The first end 16 of the exercise bar 14 being connected to a first fastening element 21 opposite the first machine body 12. The second end 17 of the exercise bar 14 is connected to the second fastening element 22 opposite the second machine body 13. In the preferred embodiment, the exercise bar 14 takes the form of an oblong handlebar that connects and engages along the first machine body 12 and second machine body 13, where the exercise bar 14 is configured to roll along the first machine body 12 and second machine body 13 in a synchronized manner.

The mounting body has a plurality of holes 44. The plurality of holes 44 allows a screw to be used to mount the mounting body 11 to any suitable frame, wall, flat surface, or any other suitable mounting element. The plurality of holes 44 traverse the length of mounting body 11 along the top edge 51 and the bottom edge 52 of the mounting body 11. The mounting body 11 has a front side 41 and a rear side 42. The mounting body 11 further comprises a user interface 33. The user interface 33 comprising a power supply 331, a power button 332, and an electronic screen 333. The user interface device 33, the resistance knob 32, and the power supply 331 are electronically connected to the processing unit. The user interface device 33 and the resistance knob 32 are connected along the mounting body 11, oriented between the first machine body 12 and second machine body 13. The resistance knob 32 adjusts the plurality of magnets 34. The power supply 331, the power button 332, and the electronic screen 333 being electrically connected. The user interface 33 being electronically connected to the plurality of magnets 34. The electronic screen monitoring the plurality of magnets 34 and the resistance knob 32.

The resistance knob 32 is rotably attached to the mounting body 11 and take a cylindrical shape. The resistance knob 32 is designed to be rotated clockwise and counterclockwise to either increase or decrease the magnetic resistance of the plurality of magnets 34 making it a more difficult exercise depending on ones strength. The resistance knob 32 being positioned on the mounting body 11 between the first machine body 12 and the second machine body 13. The resistance knob 32 rotates along a central axis of the resistance knob 32.

The first machine body 12 and second machine body 13 being terminally opposite to each other along the mounting body 11. The first machine body 12 being attached to the mounting body 11 by way of the first base connector. The second machine connects in the same manner, with the second machine body 13 being attached to the mounting body 11 by way of the second base connector 24.

The first machine body 12 further comprising a first fastening element 21 and this fixes and connects the exercise bar 14 along the pair of machine bodies. The first fastening element 21 is centrally fastened to the first machine body 12. The first fastening element 21 being an elongated arm extending radially outward from the first machine body 12. The second machine body 13 further comprises a second fastening element 22. The second fastening element 22 is centrally fastened to the second machine body 13. The second fastening element 22 is an elongated arm extending radially outward from the second machine body 13. This central attachment of the first fastening element 21 and second fastening element 22 is what assists the exercise bar 14 in rotating about the barrel pod. The first fastening element 21 and second fastening element 22 fasten along the first machine body 12 and second machine body 13 such that the exercise bar 14 rotates along the first machine body 12 and second machine body 13 in a synchronized and parallel manner.

In the preferred embodiment, the user interface device 33 takes the form of an electronic exercise tracker module that provides visual exercise statistics to the user. The user interface device 33 further comprises a wireless communication device, where the wireless communication device is configured to relay and transfer exercise statistical data from the present invention to another device such as, but not limited to smartphones, tablets, computers, or any other suitable device. The resistance knob 32 allows the user to adjust the magnetic resistance applied along the first machine body 12 and second machine body 13. The power supply 331 is suited in powering the electronic components that constitutes present invention, such as, but not limited to batteries, DC power supply, manual driven generators, or any other suitable power supply. In the preferred embodiment, the processing unit takes the form of any suitable electronics processing device that executes and handles all electronic functions that constitutes the present invention.

Although the invention has been explained in relation to its preferred embodiment, it is to be understood that many other possible modifications and variations can be made without departing from the spirit and scope of the invention.

What is claimed is:

1. A dual pod upper body exerciser comprising:

a first machine body being rotatable and including a first plurality of magnets;

a second machine body being rotatable and including a second plurality of magnets;

a mounting body being a single metal plate and including a user interface and a resistance knob, the user interface being electronically connected to the resistance knob and the first and second plurality of magnets; and an exercise bar being torsionally engaged between and rotatable along the first and second machine bodies;

wherein the first and second machine bodies being terminally opposite to each other along the mounting body;

wherein the first machine body being attached vertically adjacent to the mounting body by way of a first base connector;

wherein the second machine body being attached vertically adjacent to the mounting body by way of a second base connector; and wherein the resistance knob adjusts a magnetic resistance of the first and second plurality of magnets to adjust a difficulty to rotate the exercise bar along the first and second machine bodies.

2. The dual pod upper body exerciser as claimed in claim 1 wherein:

the first machine body further comprising a first fastening element;

the first fastening element being centrally fastened to the first machine body; and the first fastening element being an elongated arm extending radially outward from the first machine body.

3. The dual pod upper body exerciser as claimed in claim 2 wherein:

the second machine body further comprising a second fastening element;

the second fastening element being centrally fastened to the second machine body; and the second fastening element being an elongated arm extending radially outward from the second machine body.

4. The dual pod upper body exerciser as claimed in claim 3 wherein:

the exercise bar being an oblong bar;

the exercise bar having a first end and a second end;

the first end of the exercise bar being connected to the first fastening element opposite the first machine body; and the second end of the exercise bar being connected to the second fastening element opposite the second machine body.

5. The dual pod upper body exerciser as claimed in claim 1 wherein:

the user interface comprising a power supply, a power button, and an electronic screen;

the power supply, the power button, and the electronic screen being electrically connected; and the electronic screen monitoring the plurality of magnets and the resistance knob.

6. The dual pod upper body exerciser as claimed in claim 1 wherein:

the mounting body having a front side and a rear side;

the mounting body having a top edge and a bottom edge;

the mounting body having a plurality of holes;

the plurality of holes traversing a length of each of the top edge and the bottom edge; and the first machine body and the second machine body being mounted to the front side of the mounting body.

7. The dual pod upper body exerciser as claimed in claim 1 wherein:

the resistance knob being rotatably attached to the mounting body;

the resistance knob being positioned on the mounting body between the first machine body and the second machine body; and the resistance knob being cylindrical in shape.

8. The dual pod upper body exerciser as claimed in claim 1 wherein:

the resistance knob rotatable along a central axis of the resistance knob.

* * * * *